US008820108B2

(12) United States Patent
Oh et al.

(10) Patent No.: US 8,820,108 B2
(45) Date of Patent: Sep. 2, 2014

(54) REFRIGERATOR INCLUDING ICE MAKER

(75) Inventors: Seunghwan Oh, Gyeongnam (KR); Seongjae Kim, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 336 days.

(21) Appl. No.: 13/241,485

(22) Filed: Sep. 23, 2011

(65) Prior Publication Data

US 2012/0102997 A1 May 3, 2012

(30) Foreign Application Priority Data

Oct. 28, 2010 (KR) ..... 10-2010-0105891

(51) Int. Cl.
*F25C 1/22* (2006.01)
*F25C 5/06* (2006.01)

(52) U.S. Cl.
CPC ..... *F25C 5/06* (2013.01); *F25C 2305/022* (2013.01)
USPC ..... 62/340

(58) Field of Classification Search
USPC ..... 62/340, 344, 354
See application file for complete search history.

(56) References Cited

U.S. PATENT DOCUMENTS

| | | | | |
|---|---|---|---|---|
| 3,476,350 | A | 11/1969 | Geller | |
| 6,050,097 | A * | 4/2000 | Nelson et al. | 62/137 |
| 7,185,508 | B2 | 3/2007 | Voglewede et al. | |
| 2006/0065008 | A1 * | 3/2006 | Park | 62/344 |
| 2006/0086134 | A1 | 4/2006 | Voglewede et al. | |

FOREIGN PATENT DOCUMENTS

| | | | |
|---|---|---|---|
| CN | 1766469 | A | 5/2006 |
| CN | 101206092 | A | 6/2008 |
| EP | 1 653 170 | A2 | 3/2006 |
| KR | 10-2008-0042618 | | 2/2008 |

OTHER PUBLICATIONS

Chinese Office Action dated Sep. 13, 2013 for Application No. 201110329241.7, with English Translation, 26 pages.

* cited by examiner

*Primary Examiner* — Melvin Jones
(74) *Attorney, Agent, or Firm* — Fish & Richardson P.C.

(57) ABSTRACT

A refrigerator including an ice maker is disclosed. The refrigerator includes an ice maker comprising: an ice making tray rotatably provided therein; a driving unit connected with the ice making tray, to rotate the ice making tray selectively; and a cooling member provided in the ice making tray, contactable with water supplied to the ice making tray.

17 Claims, 12 Drawing Sheets

REFRIGERATOR INCLUDING ICE MAKER

CROSS-REFERENCE TO RELATED APPLICATION

This application claims priority under 35 U.S.C. §119(a) from Korean Application No. 10-2010-0105891 filed Oct. 28, 2010, the subject matter of which is incorporated herein by reference.

BACKGROUND

1. Field

Embodiments may relate to a refrigerator including an ice maker, more particularly, to a refrigerator capable of making ice more quickly by increasing a cooling speed of water received in an ice making tray.

2. Background

Generally, a refrigerator is an electric appliance that is able to freeze or refrigerate foods stored therein by using a refrigerant cycle. Such a refrigerator includes a cabinet having a storage compartment such as a freezer compartment or a refrigerator compartment and a door arranged to the cabinet to open and close the storage compartment.

An ice maker chamber is provided in the storage compartment or the door to make or keep ice. An ice maker including an ice making tray is provided in the ice making chamber. A water supply device is provided in the ice making tray to supply water to the ice making tray.

According to an ice making process performed in the conventional refrigerator, water is supplied to the ice making tray by the water supply device. Once cold air is drawn into the ice making chamber, the water received in the ice making chamber is frozen and ice having a preset shape is made.

When the ice making is complete, the ice making tray is rotated and twisted and the ice is separated from the ice making tray. The separated ice is dropped and ejected to the ice storage container arranged adjacent to the ice making tray.

In case of making ice, the ice making time is determined based on the time taken to cool the water supplied to the ice making tray to make ice (hereinafter, referenced to as "water").

Because of that, the necessity for considering user convenience by reducing such the ice making time is posed.

SUMMARY

Accordingly, the embodiments may be directed to a refrigerator including an ice maker. To solve the problems, an object of the embodiments may be to provide an ice maker capable of making ice more quickly by increasing the cooling speed of water received in an ice making tray provided therein, and a refrigerator including the ice maker.

To achieve these objects and other advantages and in accordance with the purpose of the embodiments, as embodied and broadly described herein, a refrigerator includes an ice maker including an ice making tray rotatably provided therein; a driving unit connected with the ice making tray, to rotate the ice making tray selectively; and a cooling member provided in the ice making tray, contactable with water supplied to the ice making tray.

The ice making tray may be transformable when ice is ejected and the cooling member may be transformable, corresponding to the transformation of the ice making tray.

The ice making tray may be twistably rotated and the cooling member may be twistable corresponding to the twistable rotation of the ice making tray.

The cooling member may be elastically transformable.

The cooling member may be arranged in a longitudinal direction of the ice making tray and the cooling member may be arranged inside an ice making recess formed in the ice making tray to receive water therein.

The cooling member may be mounted in the ice making tray and the cooling member may be prevented from being separated from the ice making tray.

The refrigerator may further include a fixing groove provided in the ice making tray to fixedly insert a predetermined area of the cooling member therein; and a fixing part provided in the cooling member to be inserted in the fixing groove.

A plurality of the ice making recesses may be provided and the plurality of the ice making recesses may be partitioned by a partition wall, and the cooling member may include a plurality of cooling fins arranged in each of the ice making recesses, contactable with water received in the ice making recesses, the plurality of the cooling fins spaced apart from each other; and a connection part that connects the cooling fins with each other.

The plurality of the cooling fins may form a plurality of spaces inside the ice making recesses.

The cooling fin may be a plate fin provided in a shape corresponding to a sectional shape of the ice making recess.

The connection part may be arranged above the partition wall, in a state of being bent.

The cooling member may be arranged in a longitudinal direction of the ice making tray, along a center of the inside of the ice making tray.

The cooling member may be arranged in a longitudinal direction of the ice making tray, along an inner wall of the inside of the ice making tray.

The ice making tray may further include a first partition wall arranged between an end and the other end of the ice making tray, across an inner center of the ice making tray along a longitudinal direction of the ice making tray, and the cooling member may be arranged adjacent to at least one of inner walls of the ice making tray, in opposite to the first partition wall.

The refrigerator may further include a second partition wall connectedly intersected with the first partition wall, to form a plurality of ice making recesses together with the first partition wall, and the cooling member may include a plurality of cooling fins arranged in the plurality of the ice making recesses, respectively, with being contactable with water received in the ice making recesses; and a connection part connecting the plurality of the cooling fins with each other, with being arranged above the second partition wall.

In another aspect, a refrigerator includes a cabinet having a storage compartment; a door rotatably coupled to the cabinet, to open and close the storage compartment; an ice making chamber provided in the door; an ice maker provided in the ice making chamber, wherein the ice maker may include an ice maker case; an ice making tray rotatably provided in the ice maker case, with being elastically transformable when ice is ejected; a rotation member provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

In a further aspect, a refrigerator includes a cabinet comprising a freezer compartment; and an ice maker provided in the freezer compartment, wherein the ice maker may include an ice maker case; an ice making tray rotatably provided in the ice maker case, with being elastically transformable when an ice is ejected; a driving unit provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

In a still further aspect, a refrigerator includes a cabinet comprising a freezer compartment and a refrigerator compartment; an ice making chamber provided in the refrigerator compartment, partitioned from the refrigerator compartment, to draw cold air inside the freezer compartment therein via a duct; and an ice maker provided in the ice making chamber, wherein the ice maker may include an ice maker case; an ice making tray rotatably provided in the ice maker case, with being elastically transformable when an ice is ejected; a driving unit provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

According to the embodiments, the cooling member having the cooling fins with a predetermined area may be received in the ice making recesses of the ice making tray. When the cooling member cooled by cold air contacts with the water in this state, the water may be cooled quickly by heat-exchange with the cooling member.

As a result, the ice making speed may be reduced remarkably in comparison to the ice making speed without the cooling member. Because of that, there may be an effect of the reduced ice making complete time.

Furthermore, the cooling fins of the cooling member may be elastically connected with each other. Because of that, when the ice making tray is twistably rotated in a reversed state to eject the ice, the cooling fins may perform twistable rotation corresponding to the twistable rotation of the ice making tray. As a result, the ejection of the ice making tray may not be interfered with.

A still further, the cooling member has the elastic restitution force. When the ice making tray returns after completing the ejection, the cooling member may be restituted, not be plastic-transformed. Because of that, the cooling member may constantly perform the heat-exchange with the water when the ice is ejected and it may distribute to the accelerated ice making speed.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts.

Figure 1:
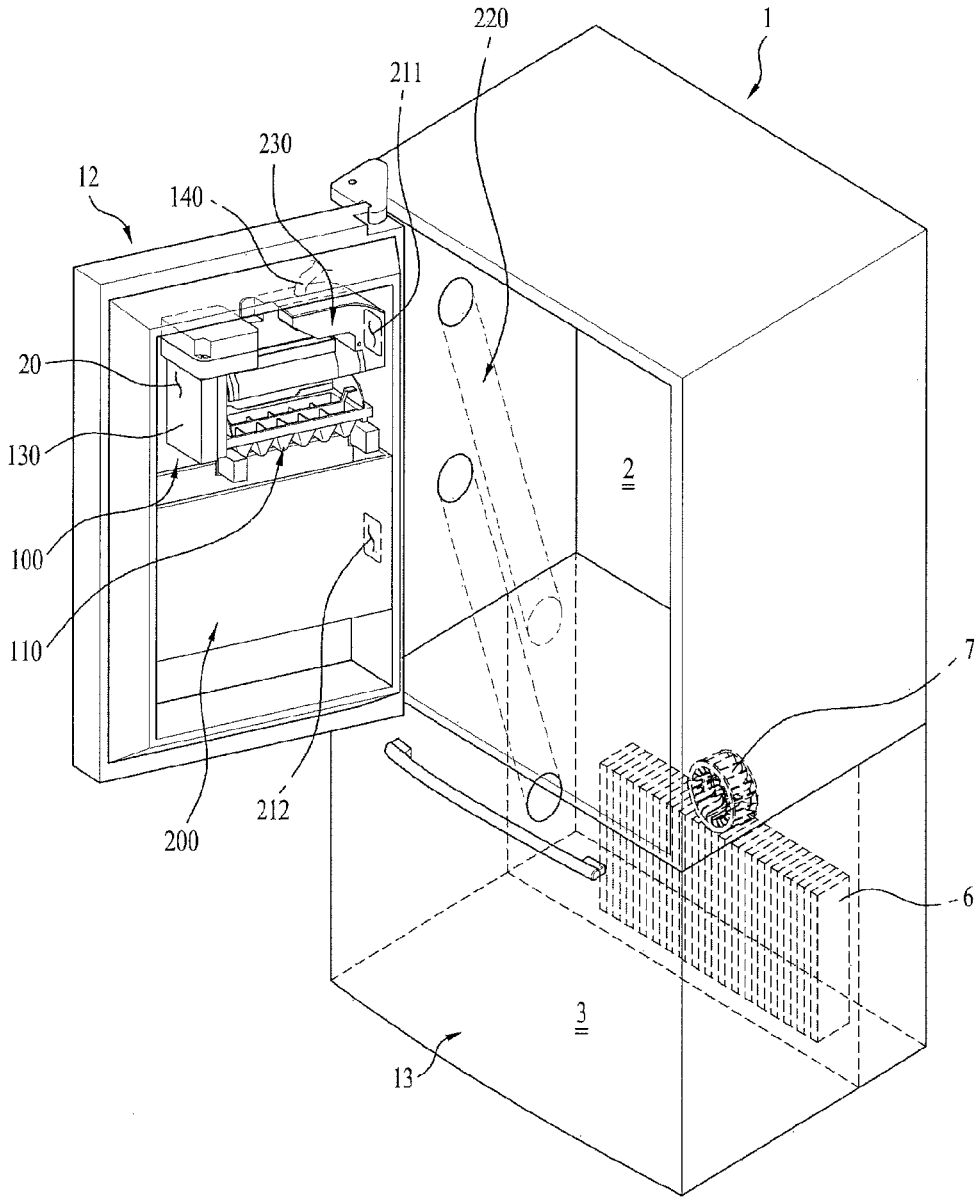
FIG. 1 is a perspective view illustrating a refrigerator including an ice maker according to an embodiment.

As shown in FIG. 1, a refrigerator according to an embodiment includes a cabinet 1 having refrigerator and freezer compartments 2 and 3, a refrigerator compartment door 12 rotatably arranged to the cabinet 1 to open and close the refrigerator compartment 2 and a freezer compartment door 13 to open and close the freezer compartment.

Here, in this embodiment, the refrigerator compartment 2 may be provided on a top of the cabinet 1 and the freezer compartment 3 may be provided on a bottom of the cabinet 1. However, the embodiment is not limited thereby. A top freezer type refrigerator including the freezer compartment 3 arranged on the top of the cabinet 1 or a side by side type refrigerator having the refrigerator and freezer compartments arranged side by side may be applied to the embodiment.

An ice making chamber 20 may be provided in a rear surface of the refrigerator compartment door 12. An ice maker 100 for making ice and an ice storage container 200 for receiving the ice ejected from the ice maker 100 may be provided in the ice making chamber 20.

The ice maker 100 may include an ice making tray 110 for receiving water therein and a driving unit 130 connected with the ice making tray 110 to rotate the ice making tray 110.

A water supply hose 140 may be provided above the ice making tray 110 to supply water to the ice making tray 110.

A cold air inlet 211 and a cold air outlet 212 may be provided in a side surface of the ice making chamber 20 to draw cold air into the ice making chamber 20 and to exhaust the cold air outside the ice making chamber 20, respectively.

The cold air inlet 211 and the cold air outlet 212 may be connected with cold air guide ducts 220 arranged in a side surface of the cabinet 1, respectively.

The cold air duct 220 may be configured to move the cold air inside the freezer compartment 3 provided in a lower area of the cabinet 1 toward the ice making chamber 20 and to re-move the cold air inside the ice making chamber 20 toward the freezer compartment 3 simultaneously.

More specifically, once cold air is generated in an evaporator 6 provided behind the freezer compartment 3, a large amount of the cold air may be drawn into the freezer compartment 3 by driving of a cold air fan 7 arranged adjacent to the evaporator 6 and some of the other cold air may be moved to the ice making chamber 20 by the guide of the cold air guide duct 220.

When a user closes the refrigerator compartment door 12 under the structure, the cold air inlet 211 and the cold air outlet 212 may be connected with the cold air guide ducts 220, respectively.

A cold air guider 230 may be provided in the ice making chamber 20 to concentrate the cold air passing out of the cold air inlet 211 into the ice making chamber 20.

The cold air guider 230 may be arranged to an inner wall of the ice making chamber 20 where the cold air inlet 211 is formed, above the ice making chamber 20, more specifically, the ice making tray 110, with being spaced from the ice making tray 110.

Here, the cold air guider 230 may be installed adjacent to the water supply hose 140.

Figure 2:
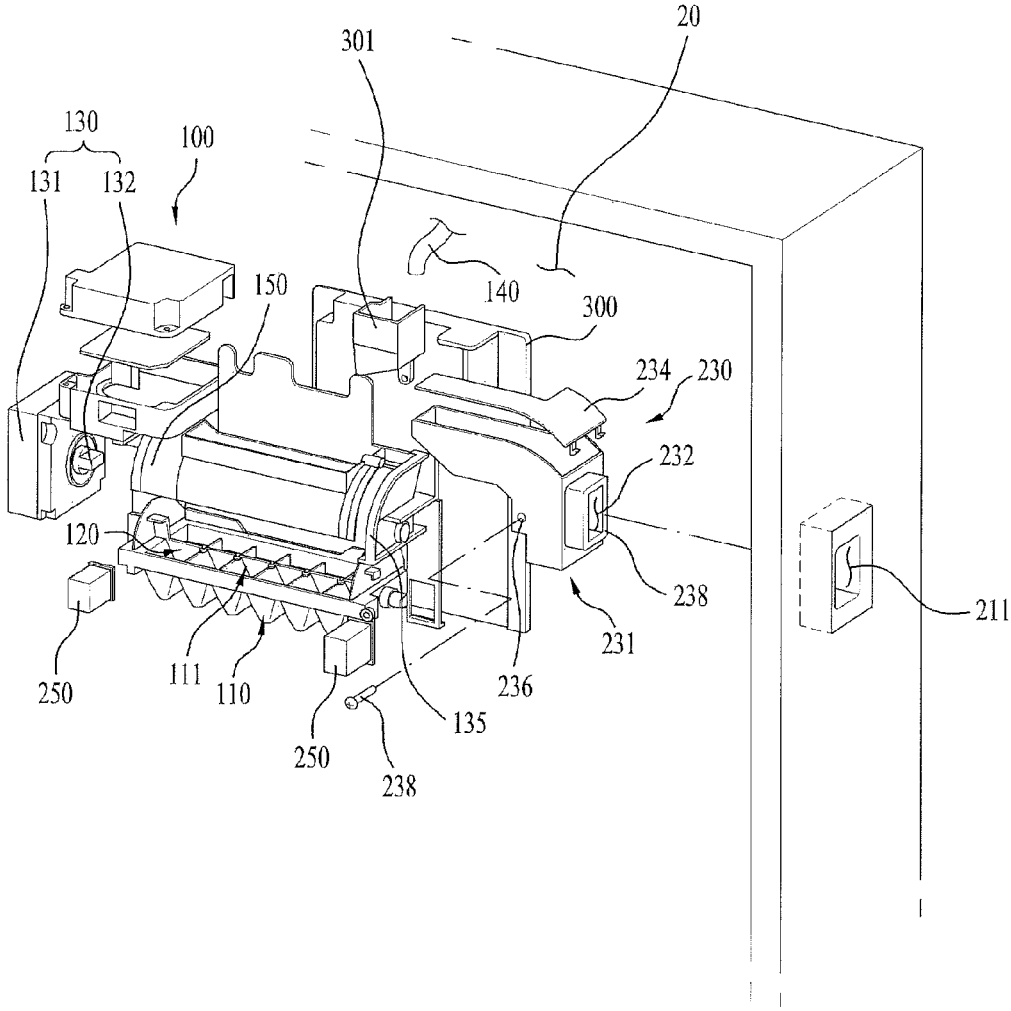
FIG. 2 is an exploded perspective view illustrating the ice maker according to the embodiment.

As shown in FIG. 2, the ice maker 100 may include the ice making tray 110, the driving unit 130 and further a water-splatter-proof plate 150. The ice making tray 110 may include an ice making recess 111 partitioned off into a plurality of specific spaces. The water-splatter-proof plate 150 may be provided adjacent to the side of the ice making tray 110. The driving unit 130 may be provided next to the ice making tray 110.

The driving unit 130 may include a case 131 and a rotation member 132 provided in the case 131. The rotation member 132 may include a rotation motor and it may be connected with the ice making tray 110 to rotate the ice making tray 110.

As a result, the ice making tray 110 receiving the ice may be rotated by the rotation of the rotation member 132. When the rotation member 132 is rotated a predetermined angle, the ice making tray 110 may be twisted and the ice received in the ice making tray 110 may be dropped and ejected there from.

In the meanwhile, a cooling member 120 may be provided in the ice making tray 110, crossing the inside of the ice making tray 110. The cooling member 120 may contact with the water provided in the ice making tray 110, to increase the cooling speed of the water.

Typically, the ice making tray 110 may be formed of a resin material having elasticity to be rotated and twisted. However, the resin material has heat conductivity that is lower than a metal material and it may have limitation of improving the cooling speed of the water.

To overcome the limitation, the cooling member 120 may be formed of a material such as a metal material, with higher heat conductivity than a heat conductivity of a material forming the ice making tray 110. The cooling member 120 formed of the material with higher heat conductivity may be arranged in the ice making tray 110, to contact with the water. Because of that, the cooling speed of the water may be increased and the ice-making time may be reduced.

Here, the cooling member 120 may be arranged along a longitudinal direction with respect to the ice making tray 110 and it may be accommodated in the ice making tray 110, with a large area thereof in contact with the water.

In the meanwhile, a full ice detecting sensor 250 may be provided below the ice making tray 110 to detect full ice inside the ice storage container (200, see FIG. 1). Here, the full ice detecting sensor 250 may be a sensor that uses an infrared ray and it may be a lever type sensor.

A fixing bracket 300 may be provided in a rear surface of the ice making tray 110 to fix the ice maker 100 in the ice making chamber 20. A water supply guider 310 may be provided in the fixing bracket 300 to guide the water supplied to the ice making tray 110.

The water supply guider 301 may receive the water discharged from the water supply hose 140 and guide it to the ice making tray 110.

The cold air guider 230 may be provided in a kind of duct shape. The cold air guider 230 may include a body 231 having an empty inside, an inlet hole 232 provided in the body 231 to communicate with the cold air inlet 211, an outlet hole 233 arranged in opposite to the inlet hole 232, and a cover member 234 detachably arranged, to define a top of the body 231.

Here, the cover member 234 could be integrally formed with the body 231.

A predetermined sealing member may be arranged between the cold air guider 230 and the cold air inlet 211, to prevent the cold air from leaking there between.

Here, a coupling hole 236 may be provided in a side surface of the cold air guider 230 and a coupling member 238 such as a screw may be inserted in the coupling hole 236 to be coupled to the fixing bracket 300. Because of that, the cold air guider 230 may fixedly coupled to the fixing bracket 300.

Figure 3:
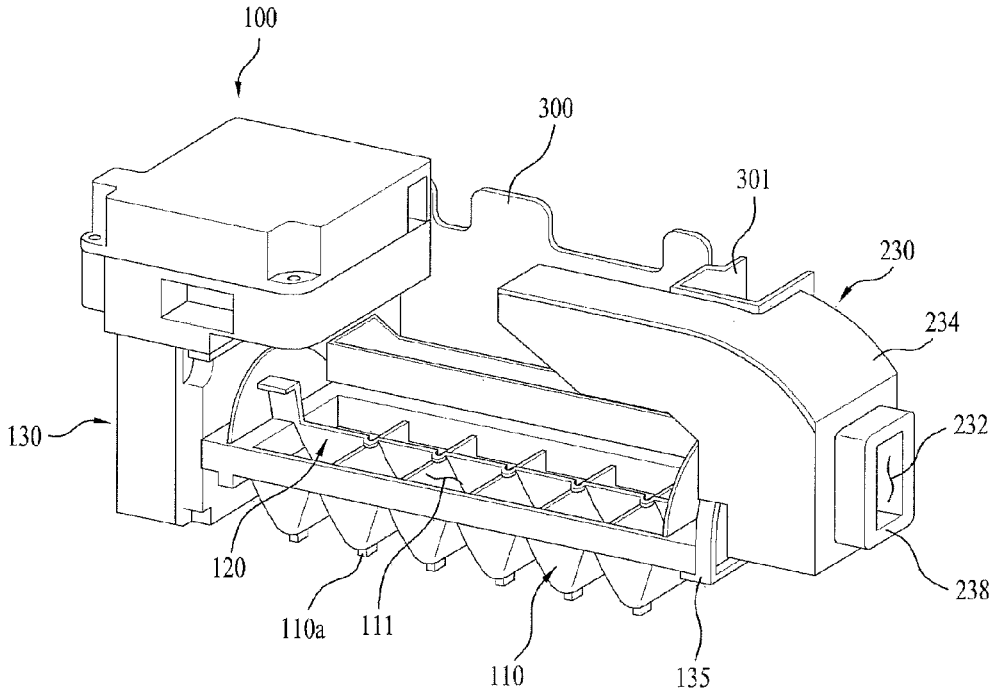
FIG. 3 is a perspective view illustrating the connection of the ice maker.

As shown in FIG. 3, a supporting member 135 may be provided in opposite to the driving unit 130 of the ice maker 100, spaced apart from the driving unit 130, to support the ice making tray 110.

A rotation limiter (not shown) may be provided in the supporting member 135. When the rotation angle of the ice making tray 110 is a preset angle, the rotation limiter may contact with the other end of the ice making tray 110 and it may limit the rotation of the ice making tray 110 as a kind of hooking protrusion.

An ice making sensor 110*a* may be provided underneath the ice making tray 110. When the ice making sensor 110*a* determines that the ice making is complete, the ice making tray 110 may be rotated by the driving of the driving unit 130.

When the ice making tray 110 is rotated, both ends of the ice making tray 110 may draw the same locus from the beginning of the rotation to a predetermined angle.

Once the other end of the ice making tray 110 contacts with the rotation limiter (not shown) during the rotation of the ice making tray 110, the rotation may not performed any further at the other end and the ice making tray 110 may stop at the point. As an end of the ice making tray 110 is connected with the rotation member (132, see FIG. 2) of the driving unit 130, the end may be rotated continuously.

As mentioned above, the rotation angle of the end is differentiated from that of the other end possessed by the ice making tray 110, the ice making tray 110 may be twisted and the ice accommodated in the ice making tray 110 may be separated and ejected there from.

In the meanwhile, the cooling member 120 received in the ice making tray 110 is connected with the ice making tray 110. Because of that, the cooling member 120 may be rotated together with the ice making tray 110 and it may be twisted corresponding to the twisting of the ice making tray 110, after that.

Figure 4:
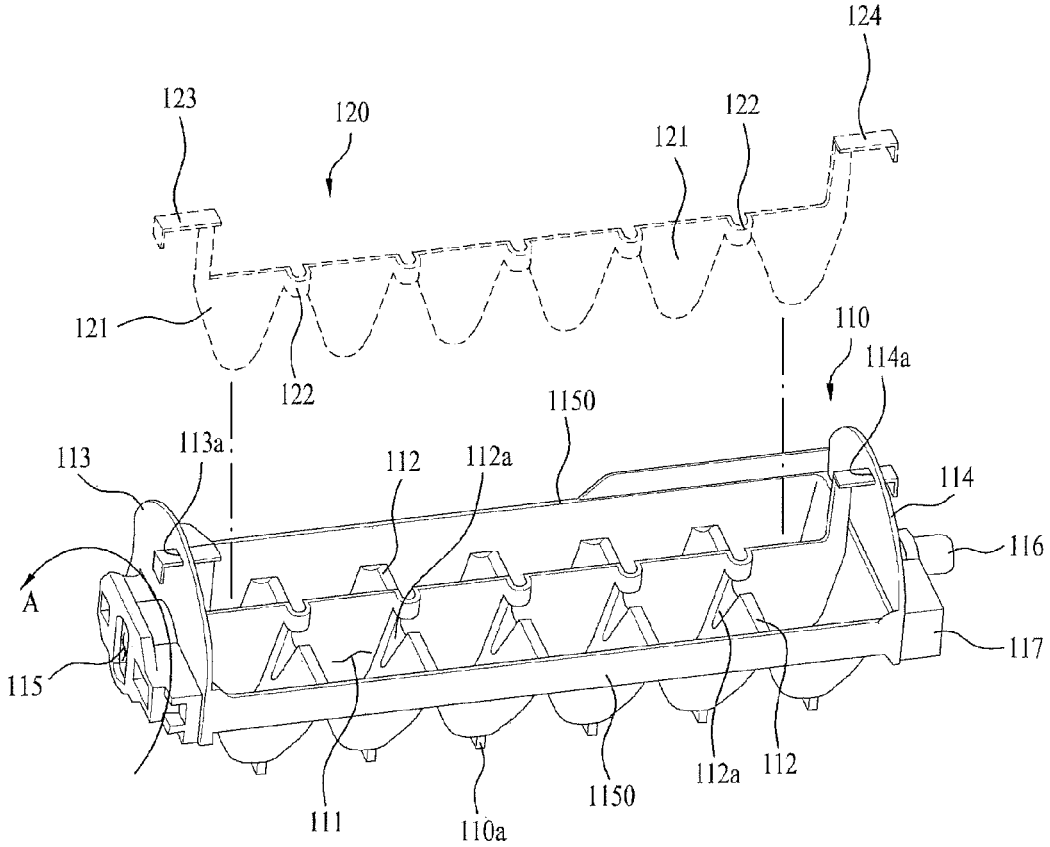
FIG. 4 is an exploded perspective view illustrating an ice making tray and a cooling member according to an embodiment.

As shown in FIG. 4, the ice making tray 110 may include the plurality of the ice making recesses 111 partitioned off into a plurality of columns by a partition wall 112.

The ice making recesses 111 may be partitioned, with a boundary with the partition wall 112. Water-splatter-proof walls 113 and 114 may be provided aside the outer-most ones arranged in both ends of the ice making recesses 111, respectively. The water-splatter-proof walls 113 and 114 may prevent the water from splattering outside, when the water is supplied.

In the meanwhile, fixing grooves 113*a* and 114*a* may be provided in the water-splatter-proof walls 113 and 114 to insert fixing parts 123 and 124 provided at both ends of the cooling member 120 therein.

A first coupling part 115 and a second coupled part 116 may be provided at both ends of the ice making tray 110, to be coupled to the rotation member (132, see FIG. 2) of the driving unit (130, see FIG. 2) and rotatably coupled to the supporting member (135, see FIG. 3), respectively.

The first coupling part 115 may be provided in a recess shape to insertedly receive the rotation member 132 therein. The second coupling part 116 may be provided in a shaft shape to be rotatably inserted in the supporting member 135.

When the rotation member 132 is rotated, the first coupling part 115 may be hallow-shaped to transfer all of the rotational force of the rotation member 132 to the ice making tray 110 to prevent the slippery of the rotation member 132.

The second coupling part 116 may be shaft-shaped, with a circular-shaped sectional area, to be rotated in relation with the supporting member 135 smoothly when the ice making tray 110 is rotated.

A protrusion 117 may be arranged next to the second coupling part 116, to be contactable with the rotation limiter provided in the supporting member 135.

In the meanwhile, the cooling member 120 may include a plurality of cooling fins spaced apart from each other, with being formed in a shape corresponding to a side sectional shape of the ice making recess 111, a connecting part 122 elastically connecting two of the cooling fins 121, and fixing parts 123 and 124 fixedly inserted in the fixing grooves 113*a* and 114*a*, respectively.

This embodiment represents that the fixing parts are provided at both ends of the cooling member 120 that they are fixedly inserted in the fixing grooves 113*a* and 114*a*. Alternatively, the fixing part may be provided at only an end of the cooling member 120 and the fixing groove may be provided next to only a single side of the ice making tray 110.

In the meanwhile, it may be considerable that the fixing part may be clip-shaped or holder-shaped to be hooked to the ice making tray 110.

The cooling fins 121 may be receivable in the ice making recesses 111, respectively, and they may contact with the water drawn into the ice making recesses 111.

The fixing parts 123 and 124 may be provided at both ends of the cooling member 120. When the fixing parts 123 and 124 are inserted in the fixing grooves 113*a* and 114*a*, ends of the fixing parts 123 and 124 may be bent downwardly to prevent the separation thereof from the fixing grooves 113*a* and 114*a*.

As a result, when the cooling member 120 is moved, the fixing parts may engage with rims of the fixing grooves 113*a* and 114*a*.

The connection parts 122 may be curved in a "U" shape to have proper elasticity, not arranged in a straight line shape, with connecting the cooling fins 121 with each other.

When the profile of the ice making tray 110 is twisted and rotated, the cooling member 120 may be twisted and rotated as well. In case the ice making tray 110 returns to its original profile after the twisting rotation, the connection parts 122 may provide the cooling member 120 with the elastic restitution to restitute the cooling member 120.

When the cooling member 120 is arranged in the ice making tray 110, each of the connection parts 122 may be arranged above each of the partition walls 112, spaced apart from each of the partition wall 112.

A passage recess 112*a* may be provided in the partition wall 112 to allow the water to move to a neighboring one of the ice making recesses 111 when one of the ice making recesses 111 is full of the water supplied to the ice making tray 110. Not to interfere with the movement of the water, the partition wall 112 may be arranged apart from the connection part 122.

The cooling member 120 may be arranged across the inside of the ice making tray 110 in horizontal or longitudinal direction and the cooling fins 121 may be accommodated in the ice making recesses 111 to partition the inside of the ice making recess 111 in to a plurality of spaces.

This is because the ice which will be made in each of the ice making recesses 111 has to be proper-sized and that the ice has to be divided.

As follows, the ice ejection according to this embodiment will be described in detail.

Figure 5:
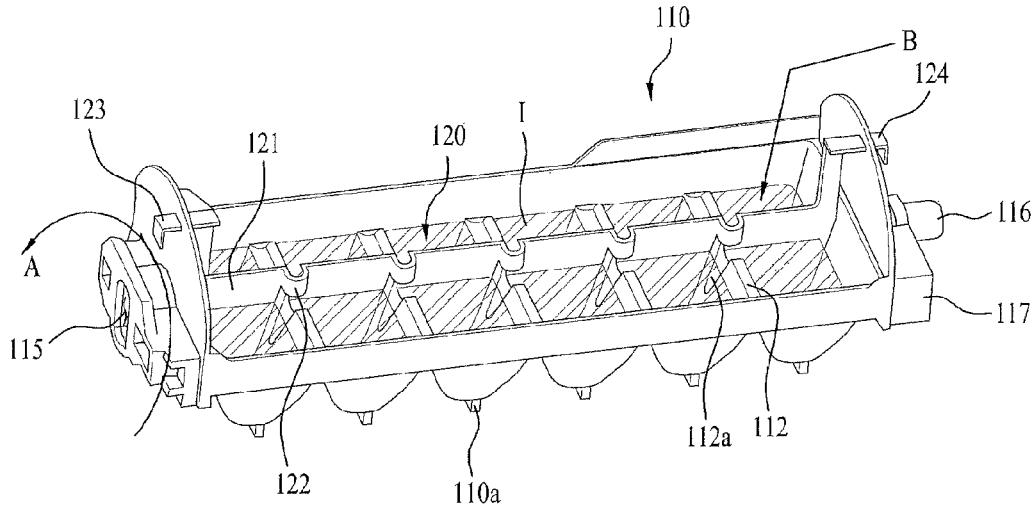
FIG. 5 is an perspective view illustrating the connection of the ice making tray and the cooling member.

As shown in FIG. 5, cold air is supplied to the ice making tray 110 and the cooling member 120. After that, the cooling fins 121 may be cooled much more quickly than the ice making tray 110 and a surface temperature of the cooling fin 121 may be decreased lower than a temperature of the water which will be supplied by that cooling.

Once the water is supplied to the inside of the ice making tray 110 in that state ("B" direction), the first one of the ice making recesses 111 where the water is dropped may be full of the water and the next one of the ice making recesses 111 may be full of the water along the guide of the passage recess 112*a*.

The water supplied to fill up the ice making recesses 111 with may contact with surfaces of the cooling fins 121 provided in the cooling member 120 of the ice making recesses 111.

As mentioned above, the temperature of the cooling fin 121 may be much lower than that of the supplied water and it may then take heat from the water.

The heat may be taken out of the water by the cold air constantly supplied to the surface of the water and the surface of the ice making tray 110. Also, the heat may be taken out of the cooling fins 121 by them. Because of that, the cooling speed of the water may be accelerated in comparison to that of the water without the cooling member 120.

Especially, the ice making tray 110 may be formed of resin and it have remarkably deteriorated heat conductivity, compared with the cooling member 120 formed of metal. Because of that, the ice making time with the cooling member 120 may be reduced remarkably in comparison to the ice making time without the cooling member 120.

Once the ice making sensor 110*a* provided underneath the ice making tray 110 determines that the ice making is complete, the ice making tray 110 may be rotated along 'A' direction by the driving of the driving unit (130, see FIG. 3).

Figure 6:
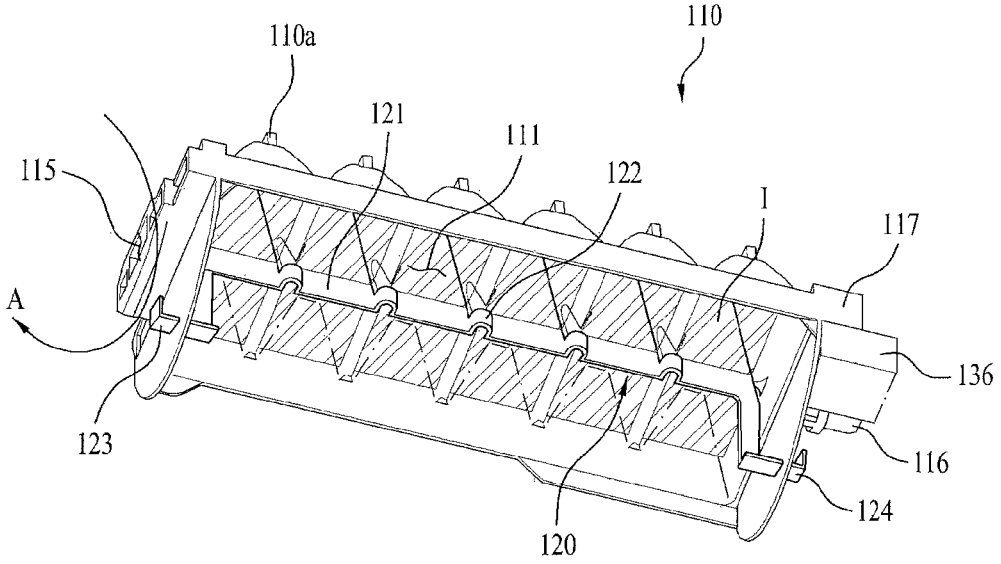
FIGS. 6 and 7 are perspective views illustrating a perspective view illustrating an ejecting operation of the ice making tray according to the embodiment.
Figure 7:
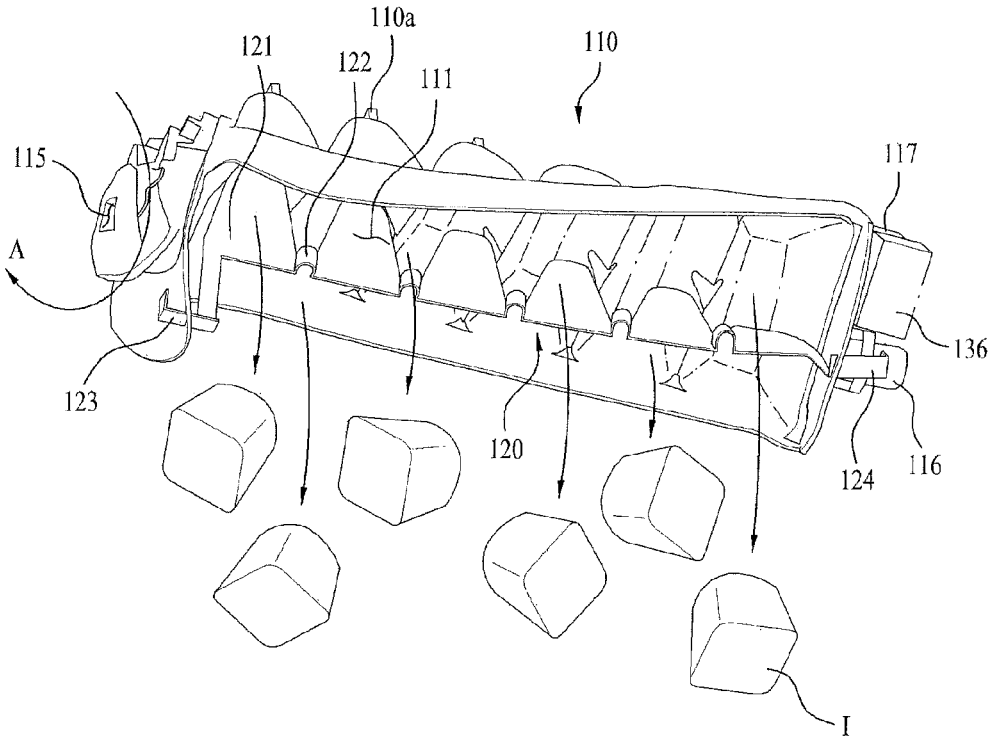

FIGS. 6 and 7 are diagrams illustrating the ice making tray 110 viewed from a reverse direction with respect to the ice making tray of FIG. 5.

When the ice making tray 110 may be rotated along "A" direction by the driving unit (130, see FIG. 3) as shown in FIG. 6, both ends of the ice making tray 110 may be rotated with drawing the same locus from the first rotation angle to a preset angle.

In other words, until the protrusion 117 provided in the other end of the ice making tray 110 contacts with the rotation limiter 136 provided in the supporting member (135, see FIG. 3), the ice making tray 110 may perform the rotation movement without transformation.

Since the profile transformation of the ice making tray 110 does not occur, the ice made in the ice making tray 110 may keep the accommodated state inside each of the ice making recesses 111 formed in the ice making tray 110. Of course, the cooling member 120 may be also positioned in the ice making tray 110, without profile transformation.

When the protrusion 117 provided in the other end of the ice making tray 110 contacts with the rotation limiter 136 to be hooked as shown in FIG. 7, the rotation of the other end may not progress any further.

However, since no obstacle such as the rotation limiter 136 is provided in the end of the ice making tray 110, the end of the ice making tray 110 may perform the rotation movement continuously.

As a result, the rotation angle of the end composing the ice making tray 110 may be different from the rotation angle of the other end, such that the ice making tray 110 may be twisted.

Because of the twisting of the ice making tray 110 mentioned above, the ice accommodated in the ice making tray 110 may be separated and ejected from the ice making recesses 111 of the ice making tray 110 to fall downwardly.

In the meanwhile, the cooling member 120 provided in the ice making tray 110 may perform twisting, corresponding to the twisting of the ice making tray 110.

The connection parts 122 may be bent, with connecting the cooling fins 121 with each other elastically. Because of that, an entire area of the cooling member 120 may be elastically transformed, not plastic-transformed.

As a result, one (that is, 124) of the fixing parts 123 and 124 provided in the cooling member 120 that is supported by the other end of the ice making tray 110 may be located at a position corresponding to a final position of the other end of the ice making tray 110. The other fixing part 123 supported by the end of the ice making tray 110 may be rotated further. Because of that, the cooling member 120 may perform the twisting.

The rotation of the end of the ice making tray 110 performed by the driving unit (130, see FIG. 3) may not last permanently but it may be stopped at a preset angle that is larger than the rotation angle of the other end of the ice making tray 110 (for example, the rotation angle of the other end of the ice making tray 110 is 150-180 degrees and the rotation angle of the end is 200-240 degrees).

When the difference between the rotation angles of the end and the other end composing the ice making tray 110 is a preset value, the ice ejection may be performed smoothly and that state may be maintained for a preset time period.

Once the time period finishes, the driving unit (130, see FIG. 3) rotates the ice making tray 110 along a reverse direction of "A" and the profiles of the ice making tray 110 and the cooling member 120 may be restituted to original ones by the elastic restitution force after the states shown in FIGS. 5 and 6.

Figure 8:
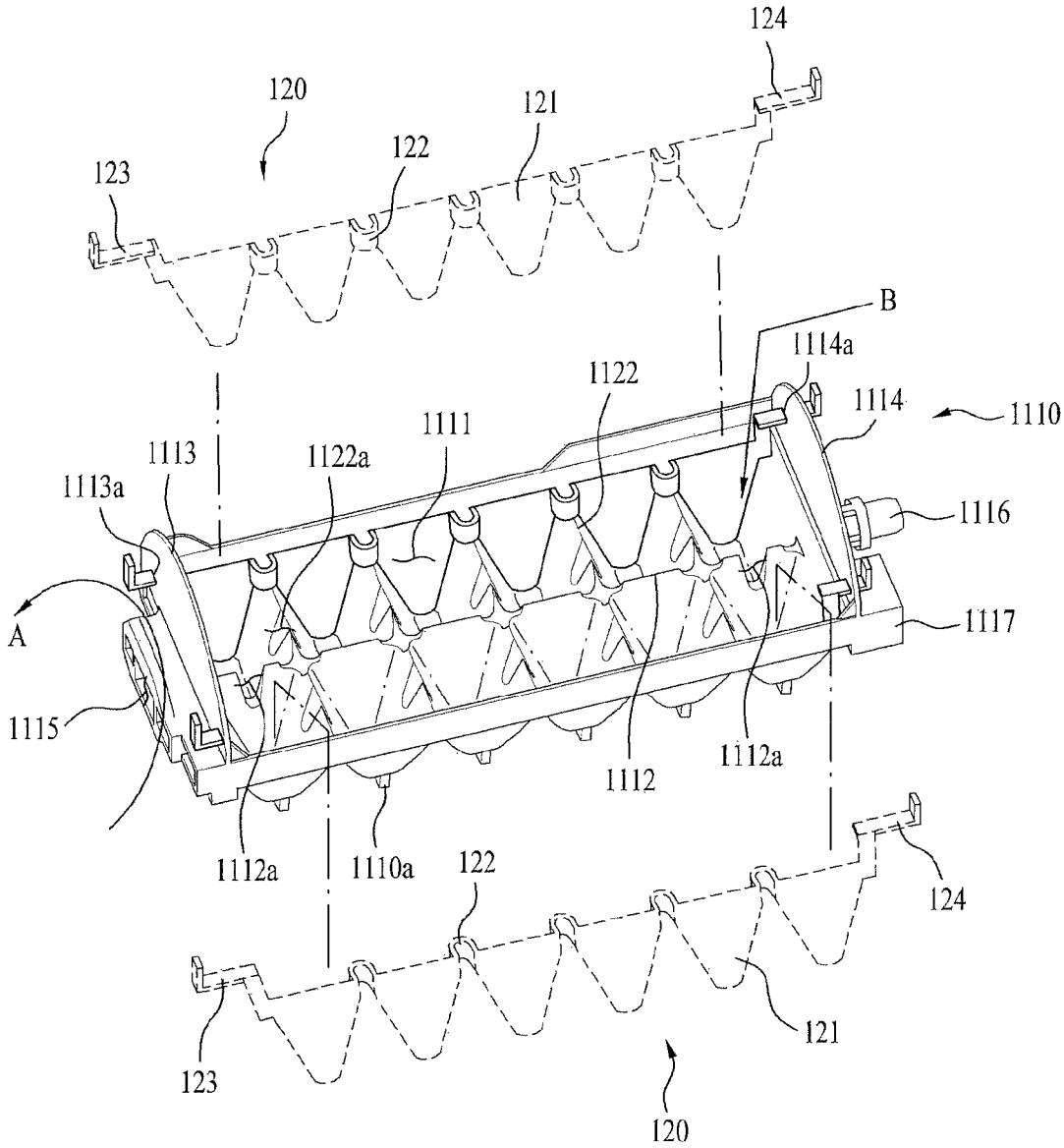
FIG. 8 is an exploded perspective view illustrating an ice making tray and a cooling member according to another embodiment.

FIG. 8 illustrates an ice maker according to another embodiment. The other elements may be the same as the elements of the above embodiment, except the ice making tray 1110 and the cooling member 120. Because of that, detailed description of the other elements will be in reference to the above embodiment.

As shown in FIG. 8, the partitioned ice making recess 1111 may be provided in the ice making tray 1110. The ice making recesses 1111 may include a first partition wall 1112 arranged across the inside the ice making tray 1110 along a longitudinal direction (a horizontal direction in the drawing of FIG. 8) and a second partition wall 1122 intersected with the first partition wall 1112, to partition off the inside of the ice making tray 1110 into a plurality of columns.

A passage recess 1112*a* may be formed in the first partition wall 1112 to guide the full water inside one of the ice making recesses 1111 toward a neighboring one of the ice making recesses 1111.

Water-splatter-proof walls 1113 and 1114 may be provided next to outer-most ones of the ice making recesses 111 to prevent water supplied as the water from splattering outside.

According to this embodiment, two cooling members 120 may be arranged adjacent to an inner wall 1150 of the ice making tray 1110, distant from each other, different from the single cooling member 120 located in the center of the ice making tray according to the above embodiment.

As a result, fixing grooves 1113*a* and 1114*a* may be provided in the water-splatter-proof walls 1113 and 1114 to fixedly insert the fixing parts 123 and 124 provided at both ends of the cooling member 120 therein. However, the positions of the fixing grooves 1113*a* and 1114*a* may be different from those of the fixing grooves described in the above embodiment.

In other words, the two fixing grooves 1113*a* and 1114*a* may be arranged in side areas of each water-splatter-proof wall 1113 and 1114.

A first coupling part 1115 insertedly coupled to a rotation member (132, see FIG. 2) of the driving unit (130, see FIG. 2) and a second coupling part 1116 rotatably coupled to the supporting member (135, see FIG. 3) may be provided at both ends of the ice making tray 1110, respectively.

The first coupling part 1115 may be groove-shaped to insert the rotation member 132 thereto. The second coupling part 1116 may be shaft-shaped to be rotatably inserted in the supporting member 135.

The first coupling part 1115 may be formed in a hollow shape to prevent slippery to transfer all the rotational force of the rotation member 132 to the ice making tray 1110.

The second coupling part 1116 may be shaft-shaped, with a circular-shaped sectional area, to be rotated in relation with the supporting member 135 smoothly when the ice making tray 1110 is rotated.

A protrusion 1117 may be arranged next to the second coupling part 1116, to be contactable with a rotation limiter provided in the supporting member 135.

In the meanwhile, the cooling member 120 may include a plurality of cooling fins spaced apart from each other, with being formed in a shape corresponding to a side sectional area of the ice making recess 1111, a connecting part 122 elastically connecting two of the cooling fins 121, and fixing parts 123 and 124 fixedly inserted in the fixing grooves 1113*a* and 114*a*, respectively.

The cooling fins 121 may be receivable in the ice making recesses 1111, respectively, and they may contact with the water drawn into the ice making recesses 1111.

The fixing parts 123 and 124 may be provided at both ends of the cooling member 120. When the fixing parts 123 and 124 are inserted in the fixing grooves 1113*a* and 1114*a*, ends of the fixing parts 123 and 124 may be bent downwardly to prevent the separation thereof from the fixing grooves 1113*a* and 1114*a*.

As a result, when the cooling member 120 is moved, the fixing parts 123 and 124 may engage with rims of the fixing grooves 1113*a* and 1114*a*.

The connection parts 122 may be curved in a "U" shape to have proper elasticity, not arranged in a straight line shape, with connecting the cooling fins 121 with each other.

When the ice making tray 1110 is twisted and rotated, the cooling member 120 may be twisted and rotated as well. In case the ice making tray 1110 returns to its original position after the twisting rotation, the connection parts 122 may provide the cooling member 120 with the elastic restitution to restitute the cooling member 120.

When the cooling member 120 is arranged in the ice making tray 1110, each of the connection parts 122 may be arranged above the first partition wall 1112, spaced apart from a top surface of the first partition wall 1112.

Like the above embodiment, the first partition wall 1112 may be arranged apart from the connection part 122 not to interfere with the movement of the water among the ice making recesses 1111.

This embodiment also represents that the cooling member 120 may be arranged across the inside of the ice making tray 1110 in horizontal or longitudinal direction and that the cooling fins 121 may be accommodated in the ice making recesses 1111.

As follows, the operation of the embodiment will be described.

As shown in FIG. 8, cold air may be supplied near the ice making tray 1110 and the cooling member 120. After that, the cooling fins 121 may be cooled much more quickly than the ice making tray 1110 and a surface temperature of the cooling fin 121 may be decreased lower than a temperature of the water which will be supplied by that cooling.

Once the water is supplied to the inside of the ice making tray 1110 ("B" direction) in that state, the first one of the ice making recesses 1111 where the water is dropped may be full of the water. After that, the next one of the ice making recesses 1111 may be full of the water along the guide of the passage recess 1112*a* provided in the first partition wall 1112 and the passage recess 1112*a* provided in the second partition wall 1122.

The full water of the ice making recesses 1111 with may contact with surfaces of the cooling fins 121 provided in the cooling member 120 accommodated in the ice making recess 1111.

The cooling member 120 may be provided in each of the inner walls of the ice making tray 1110. Because of that, the cooling speed for the water independently accommodated in each of the ice making recesses may be increased.

As mentioned above, the temperature of the cooling fin 121 may be much lower than that of the supplied water and it may take heat from the water because of that.

The heat may be taken out of the water by both the cold air constantly supplied to the surface of the water and the surface of the ice making tray 1110. Also, the heat may be taken out of the cooling fins 121 by them. Because of that, the cooling speed of the water may be accelerated in comparison to that of the water without the cooling member 120.

Even in this embodiment, the ice making tray 1110 may be formed of resin and it have remarkably deteriorated heat conductivity, compared with the cooling member 120 formed of metal. Because of that, the ice making time with the cooling member 120 may be reduced remarkably in comparison to the ice making time without the cooling member 120.

Once the ice making sensor 110*a* provided underneath the ice making tray 1110 determines that the ice making is complete, the ice making tray 1110 may be rotated along 'A' direction by the driving of the driving unit (130, see FIG. 3).

Figure 9:
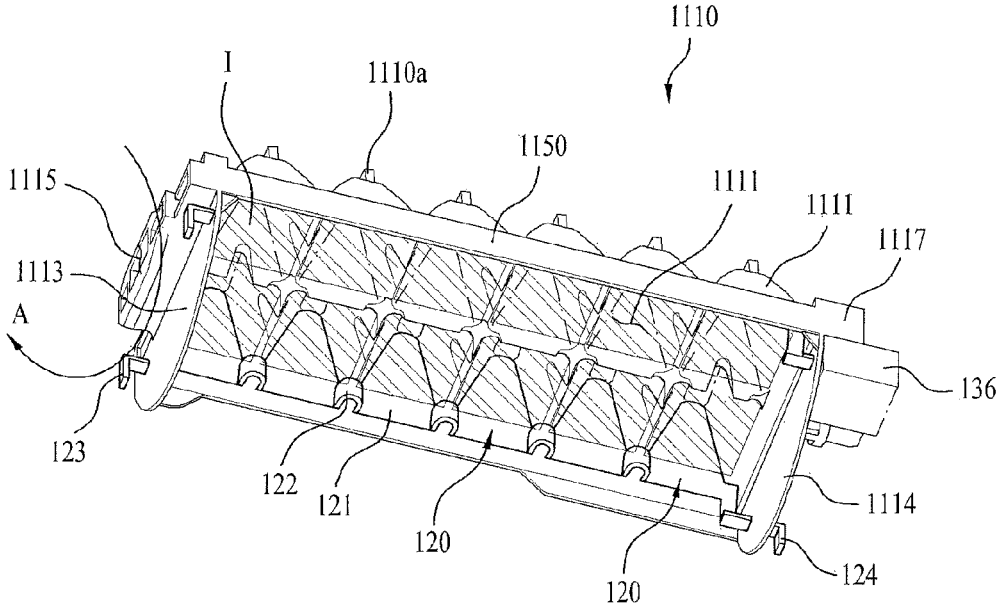
FIGS. 9 and 10 are perspective views illustrating an ejecting operation performed in the ice making tray according to the embodiment shown in FIG. 8.
Figure 10:
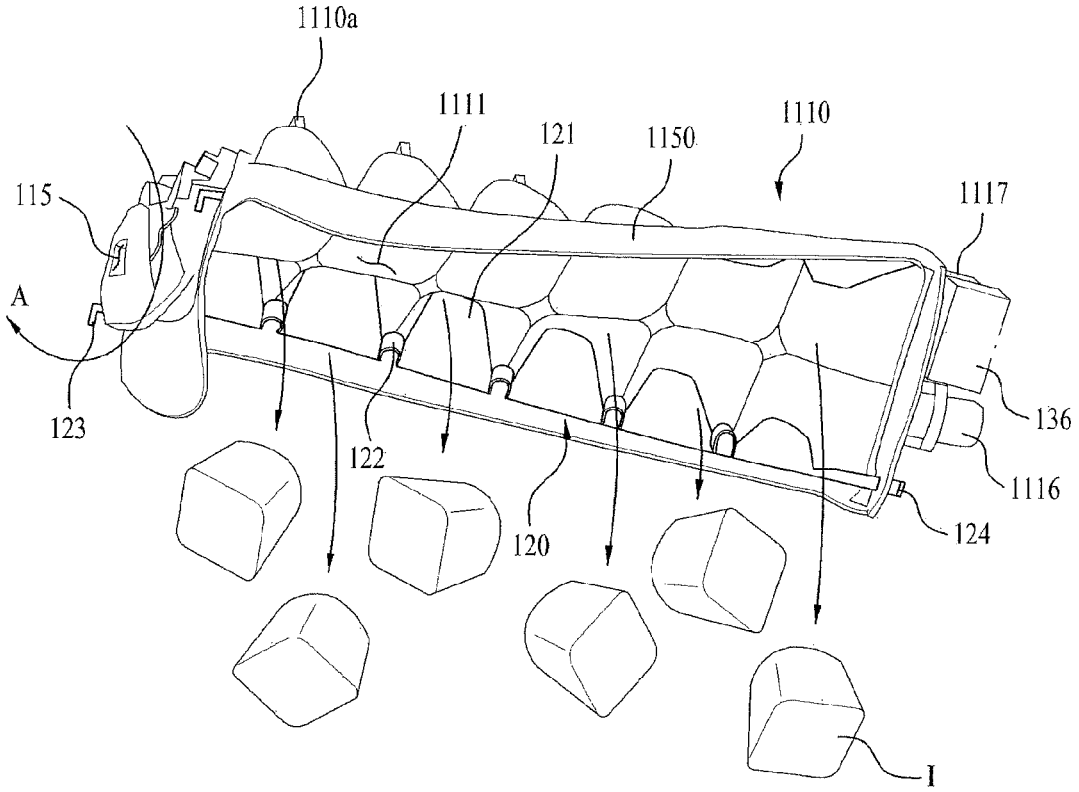

FIGS. 9 and 10 are diagrams illustrating the ice making tray 1110 viewed from a reverse direction with respect to the ice making tray of FIG. 8.

When the ice making tray 1110 may be rotated along "A" direction by the driving unit (130, see FIG. 3) as shown in FIG. 9, both ends of the ice making tray 1110 may be rotated with drawing the same locus from an initial rotation point to a preset angle.

In other words, until the protrusion 1117 provided in the other end of the ice making tray 1110 contacts with the rotation limiter 136 provided in the supporting member (135, see FIG. 3), the ice making tray 1110 may perform the rotation movement without transformation.

Since the profile transformation of the ice making tray 1110 does not occur, the ice made in the ice making tray 1110 may keep the accommodated state inside each of the ice making recesses 1111 formed in the ice making tray 1110. Of course, the cooling member 120 may be also positioned in the ice making tray 1110, without profile transformation.

When the protrusion 1117 provided in the other end of the ice making tray 1110 contacts with the rotation limiter 136 to be hooked as shown in FIG. 10, the rotation of the other end may not progress any further.

However, since no obstacle such as the rotation limiter 136 is provided in the end of the ice making tray 1110, the end of the ice making tray 1110 may perform the rotation movement continuously.

As a result, the rotation angle of the end composing the ice making tray 1110 may be different from the rotation angle of the other end, such that the ice making tray 1110 may be twisted.

Because of the twisting of the ice making tray 1110 mentioned above, the ice accommodated in the ice making tray 1110 may be separated and ejected from the ice making recesses 1111 of the ice making tray 1110 to fall downwardly.

In the meanwhile, the cooling members 120 provided adjacent to the inner walls of the ice making tray 1110 may perform twisting, corresponding to the twisting of the ice making tray 1110.

The connection parts 122 may be bent, with connecting the cooling fins 121 with each other elastically. Because of that, an entire area of the cooling member 120 may be elastically transformed, not plastic-transformed.

As a result, one (that is, 124) of the fixing parts 123 and 124 provided in the cooling member 120 that is supported by the other end of the ice making tray 1110 may be located at a position corresponding to a final position of the other end of the ice making tray 1110. The other fixing part 123 supported by the end of the ice making tray 1110 may be rotated further. Because of that, the cooling member 120 may perform the twisting.

The rotation of the end of the ice making tray 1110 performed by the driving unit (130, see FIG. 3) may not last permanently but it may be stopped at a preset angle that is larger than the rotation angle of the other end of the ice making tray 1110 (for example, the rotation angle of the other end of the ice making tray 1110 is 150-180 degrees and the rotation angle of the end is 200-240 degrees).

When the difference between the rotation angles of the end and the other end composing the ice making tray 1110 is a preset value, the ice ejection may be performed smoothly and that state may be maintained for a preset time period.

Once the time period finishes, the driving unit (130, see FIG. 3) rotates the ice making tray 1110 along a reverse direction of "A".

After that, the profiles of the ice making tray 1110 and the cooling member 120 may be restituted to original profiles by the elastic restitution force after the states shown in FIGS. 9 and 8.

Figure 11:
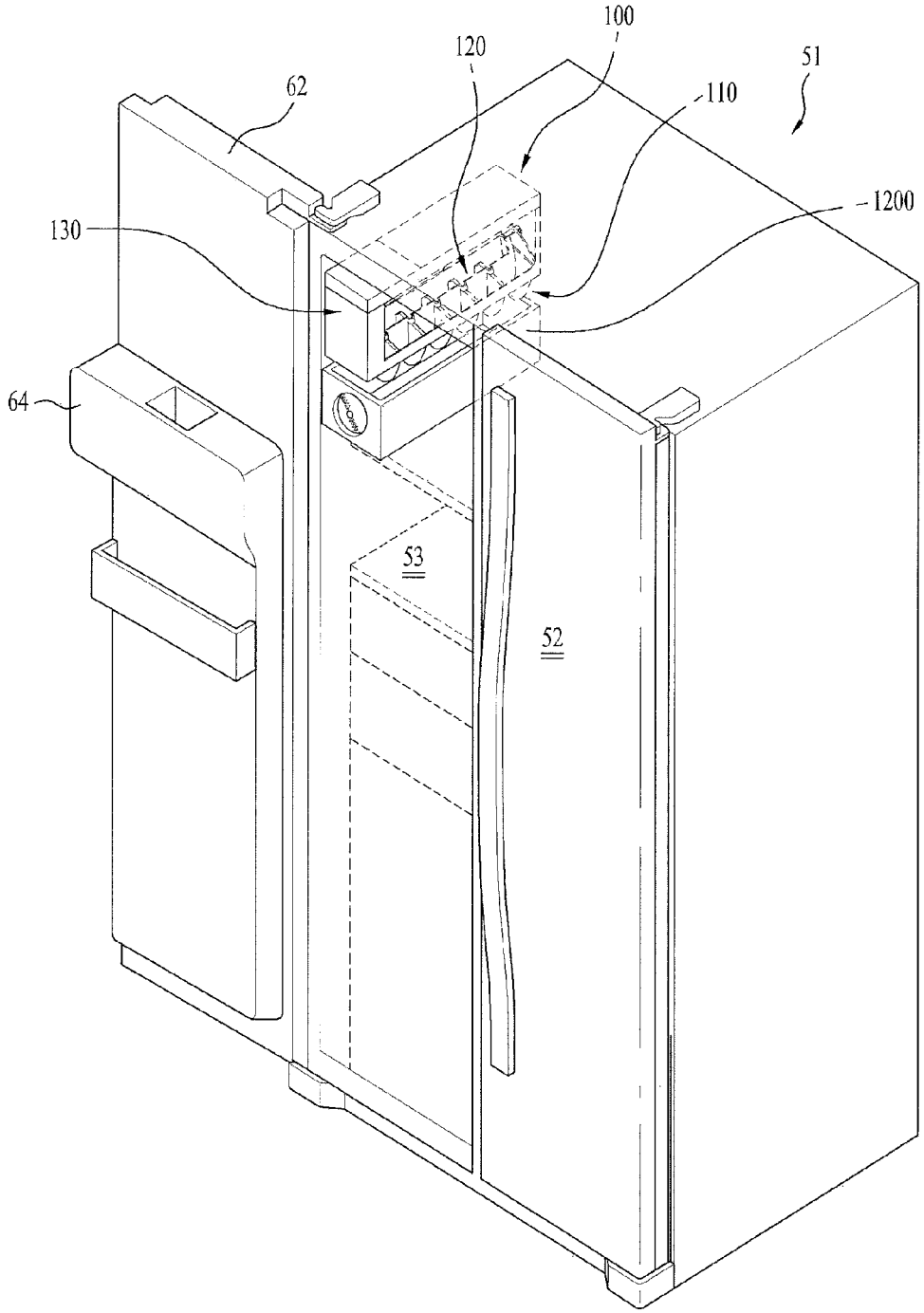
FIG. 11 is a perspective view illustrating a refrigerator including the ice maker arranged in a freezer compartment provided therein.
Figure 12:
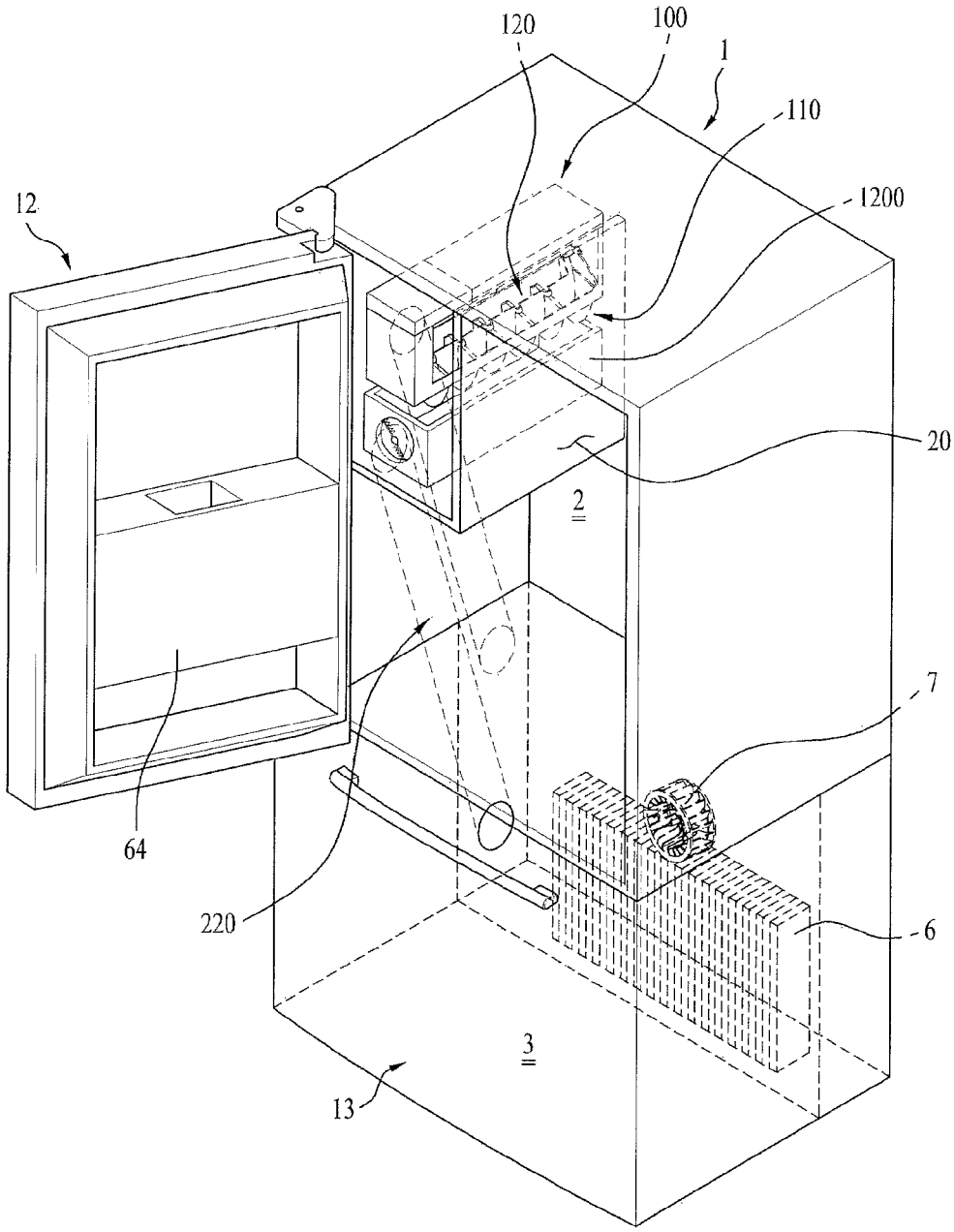
FIG. 12 is a perspective view illustrating a refrigerator including the ice maker arranged in a refrigerator compartment provided therein.

FIGS. 11 and 12 illustrate the ice maker shown in FIGS. 2 through 10 that is arranged in a refrigerator having a different structure from the structure of the refrigerator shown in FIG. 1.

The ice maker arranged in FIGS. 11 and 12 may include the cooling member and the ice making tray according to the former embodiment or it may include the cooling member and the ice making tray according to the latter embodiment.

In FIG. 11, a refrigerator compartment 53 may be provided in a left area of a cabinet 51 and a freezer compartment 52 may be provided in a right area of the cabinet 51. The ice maker 100 and an ice storage container 1200 may be provided in an upper area of the freezer compartment.

The freezer compartment 53 may be provided below zero degree. Because of that, an auxiliary ice making chamber configured to heat-insulate the area near the ice maker 100 may not be necessary.

Here, the ice storage container 1200 may be in communication with a dispenser 64 provided in a freezer compartment door opening and closing the freezer compartment 53, and the embodiment may not be limited thereby.

The configuration and operation of the ice maker shown in FIG. 11 may be the same as those of the ice maker shown in FIG. 1, and detailed description of them will be omitted accordingly.

A structure of a refrigerator shown in FIG. 12 is the same as the structure of the refrigerator shown in FIG. 12, except that the ice maker is arranged in a refrigerator compartment.

As a result, an auxiliary ice making chamber 20 for accommodating the ice maker 100 and an ice storage container 1200 may be provided in the refrigerator compartment 2 to heat-insulate them with respect to the refrigerator compartment 2.

The temperature of the refrigerator compartment 2 may be above zero. If the ice maker 100 and the ice storage container 1200 are not partitioned off from the refrigerator compartment 2, ice ejection and ice storage may be impossible.

Also in the refrigerator, the configuration of the ice maker 100 accommodated in the ice making chamber 20 may be the same as that of the ice maker according to the embodiments described in reference to FIGS. 2 through 10, and detailed description of the configuration of the ice maker 100 will be omitted accordingly.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an ice maker comprising:

an ice making tray rotatably provided therein;

a driving unit connected with the ice making tray, to rotate the ice making tray selectively; and a cooling member provided in the ice making tray, contactable with water supplied to the ice making tray, wherein a plurality of ice making recesses are provided and the plurality of the ice making recesses are partitioned by a partition wall, and the cooling member comprises:

a plurality of cooling fins arranged in each of the ice making recesses and contactable with water received in the ice making recesses, the plurality of the cooling fins being spaced apart from each other, and a connection part that connects the cooling fins with each other.

2. The refrigerator of claim 1, wherein the ice making tray is transformable when ice is ejected, and the cooling member is transformable, corresponding to the transformation of the ice making tray.

3. The refrigerator of claim 2, wherein the ice making tray is twistably rotated, and the cooling member is twistable corresponding to the twistable rotation of the ice making tray.

4. The refrigerator of claim 2, wherein the cooling member is elastically transformable.

5. The refrigerator of claim 2, wherein the cooling member is arranged in a longitudinal direction of the ice making tray, and the cooling member is arranged inside an ice making recess formed in the ice making tray to receive water therein.

6. The refrigerator of claim 2, wherein the cooling member is mounted in the ice making tray and the cooling member is prevented from being separated from the ice making tray.

7. The refrigerator of claim 2, further comprising:

a fixing groove provided in the ice making tray to fixedly insert a predetermined area of the cooling member therein; and a fixing part provided in the cooling member to be inserted in the fixing groove.

8. The refrigerator of claim 1, wherein the plurality of the cooling fins form a plurality of spaces inside the ice making recesses.

9. The refrigerator of claim 1, wherein the cooling fin is a plate fin provided in a shape corresponding to a sectional shape of the ice making recess.

10. The refrigerator of claim 1, wherein the connection part is arranged above the partition wall, in a state of being bent.

11. The refrigerator of claim 2, wherein the cooling member is arranged in a longitudinal direction of the ice making tray, along a center of the inside of the ice making tray.

12. The refrigerator of claim 2, wherein the cooling member is arranged in a longitudinal direction of the ice making tray, along an inner wall of the inside of the ice making tray.

13. The refrigerator of claim 2, wherein the ice making tray further comprises, a first partition wall arranged between an end and the other end of the ice making tray, across an inner center of the ice making tray along a longitudinal direction of the ice making tray, and the cooling member is arranged adjacent to at least one of inner walls of the ice making tray, in opposite to the first partition wall.

14. The refrigerator of claim 13, further comprising:

a second partition wall connectedly intersected with the first partition wall, to form a plurality of ice making recesses together with the first partition wall, and the cooling member comprises, a plurality of cooling fins arranged in the plurality of the ice making recesses, respectively, with being contactable with water received in the ice making recesses; and a connection part connecting the plurality of the cooling fins with each other, with being arranged above the second partition wall.

15. A refrigerator comprising:

a cabinet comprising a storage compartment;

a door rotatably coupled to the cabinet, to open and close the storage compartment;

an ice making chamber provided in the door;

an ice maker provided in the ice making chamber, wherein the ice maker comprises, an ice maker case;

an ice making tray rotatably provided in the ice maker case, with being elastically transformable when ice is ejected;

a rotation member provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

16. A refrigerator comprising:

a cabinet comprising a freezer compartment; and an ice maker provided in the freezer compartment, wherein the ice maker comprises, an ice maker case;

an ice making tray rotatably provided in the ice maker case, with being elastically transformable when an ice is ejected;

a driving unit provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

17. A refrigerator comprising:

a cabinet comprising a freezer compartment and a refrigerator compartment;

an ice making chamber provided in the refrigerator compartment, partitioned from the refrigerator compartment, to draw cold air inside the freezer compartment therein via a duct; and an ice maker provided in the ice making chamber, wherein the ice maker comprises, an ice maker case;

an ice making tray rotatably provided in the ice maker case, with being elastically transformable when an ice is ejected;

a driving unit provided in the ice maker case, with being connected with the ice making tray to rotate the ice making tray selectively; and a cooling member arranged in the ice making tray, with being contactable with water supplied to the ice making tray, the cooling member being elastically transformable corresponding to the transformation of the ice making tray.

* * * * *